US006764195B1

(12) United States Patent
Cutliff

(10) Patent No.: US 6,764,195 B1
(45) Date of Patent: Jul. 20, 2004

(54) ORNAMENT NETTING

(76) Inventor: Yate K. Cutliff, 301 42nd St. North, St. Petersburg, FL (US) 33713

( * ) Notice: Subject to any disclaimer, the term of this patent is extended or adjusted under 35 U.S.C. 154(b) by 0 days.

(21) Appl. No.: 10/329,038

(22) Filed: Dec. 24, 2002

(51) Int. Cl.[7] ..... F21W 121/04

(52) U.S. Cl. ..... 362/123; 362/252; 362/806; 428/19

(58) Field of Search ..... 362/122, 123, 362/565, 567, 568, 806, 249, 252; 428/18, 19

(56) References Cited

U.S. PATENT DOCUMENTS 3,819,459 A * 6/1974 Wren ..... 362/123
4,736,282 A * 4/1988 Ahroni ..... 362/123
5,057,976 A * 10/1991 DuMong ..... 362/123
5,523,130 A * 6/1996 Sullivan ..... 428/19
D384,174 S * 9/1997 Smith ..... D26/25
6,334,694 B1 * 1/2002 Huang ..... 362/123

* cited by examiner

*Primary Examiner*—Laura K. Tso
(74) *Attorney, Agent, or Firm*—Edward P. Dutkiewicz; Yate K. Cutliff

(57) ABSTRACT

An ornamental netting including a web-like structure having an array of loops integral the material forming the web-like structure, with the loops receiving the hooks of ornaments, the ornamental netting sized for positioning over a Christmas tree or other structure. The ornamental netting further having an array of electrical lights.

13 Claims, 4 Drawing Sheets

FIG 3
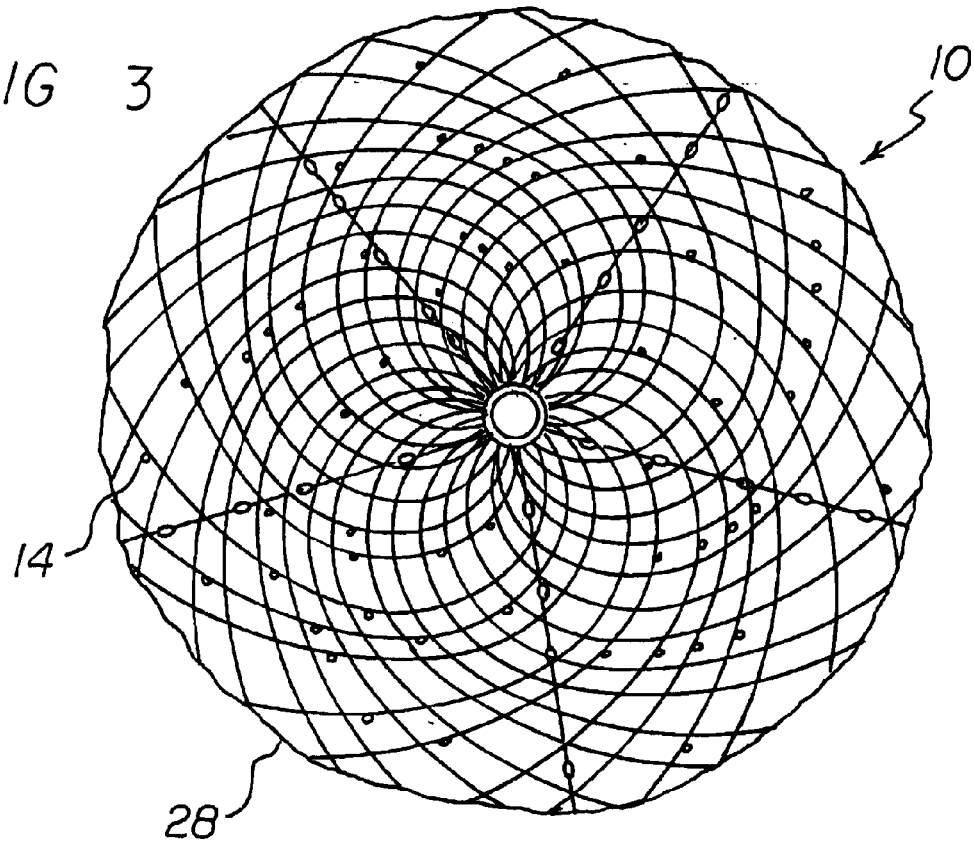
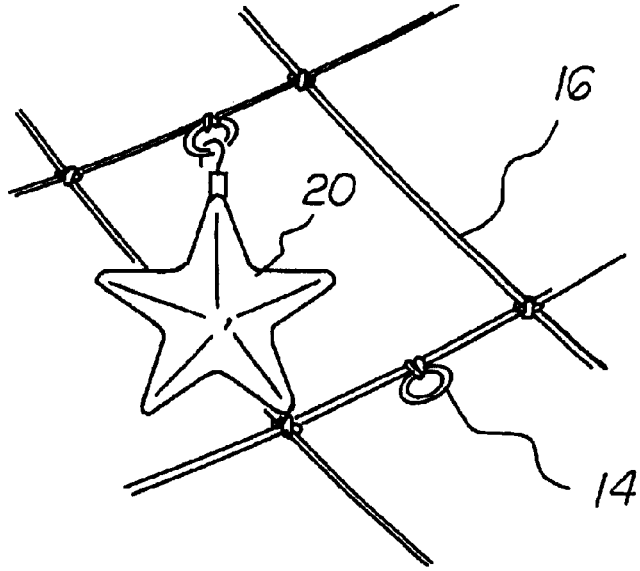
FIG 4

ORNAMENT NETTING

BACKGROUND OF THE INVENTION

The present invention relates to ornament netting and more particularly pertains to a net having integrated loops proportionately spaced thereabout so that ornaments may be hung thereon after the netting is mounted as a single unit on a structures such as a Christmas tree or the like.

Decoration of trees and other structures has become traditional on holidays and during times of celebrations, such as Christmas, Hanukkah, Halloween, weddings, birthdays and anniversaries. Typically, the ornament or ornament type decorations are hung, using a hook, individually on the tree branch, tree limb or whatever the structure may have available for receiving the hook. After the ornaments are place one at a time during the decoration process, each must be removed one at a time when the decorations are to be removed.

Often the decoration process is fun and many times involves one or more persons. Unfortunately, when it is time to take down the decorations, the process is considered tedious and time consuming. In an effort to hurry the ornament removal process people tend to be careless and many treasured ornaments are broken. Additionally, in today's fast pace world people are looking for quick and easy ways to save time and reduce the amount of work involved in a task. Therefore, there are those that simply do not remove the ornaments and just throw the structure with the hanging ornaments away. Over time, throwing away the structure with the hanging ornaments can be costly, expensive and an emvironment hazard.

Various apparatus are available to the decorator for hanging ornaments therefrom. For example, U.S. Pat. No. 6,123,238; U.S. Pat. No. 6,012,590; U.S. Pat. No. 5,523,130; U.S. Pat. No. 4,145,731 and U.S. Pat. No. 3,435,552. These apparatus however, generally require the one by one removal of the ornament. Thus it is desirable to provide an apparatus which will allow quick and easy removal of a plurality of ornaments.

BRIEF SUMMARY OF THE INVENTION

In light of the foregoing disadvantages revealed under the prior art, the present invention provides an ornament netting that in its preferred embodiments comprises a net with loops that receive ornament hooks. Further, the net with hanging ornaments is easily placed over and/or removed from either the tree or other structure.

After extensive study and testing of ornament netting apparatus designs, the present inventor discovered that the net with integral loops proportionately spaced thereon, can have a variety of shapes and is easily mounted and removed with ornaments hanging thereon.

Accordingly, a primary function of the ornament netting is to provide an improved apparatus, that is unitary and readily mountable on a more or less conical tree or other structure in a simple manner. Specifically, the ornament netting solves the problems inherent with the prior art references in use today, that is, one by one removal of the ornaments. As such, the general purpose of the present invention will be described subsequently in greater detail.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions in so far as they do not depart from the spirit and scope of the present invention.

It is therefore an object of the present invention to provide an ornament net which has loops integral the string, cord or thread of the net.

Another object of the present invention is to provide an ornament net wherein the string, cord or thread of the net having the loops are parallel.

Another object of the present invention is to provide an ornament net, which can be easily and efficiently manufactured and marketed.

Yet, another object of the present invention is to provide an ornament net that is mountable onto a tree or other structure.

A further object of the present invention is to provide an ornament net that is mountable on a tree or structure after hanging the ornaments from the loops of the net.

It is a further object of the present invention to provide a ornament net that allows ornaments to be hung from the loops of the net after the net is mounted onto a tree or other structure.

An even further object of the present invention is to provide an ornament netting which is susceptible of a low cost of manufacture with regard to both materials and labor, and which accordingly is then susceptible of low prices of sale to the consuming public, thereby making such ornament netting economically available to the buying public.

Still another object of the present invention is to provide an ornament net that is easily removed from the tree or other structure while the ornaments remain hanging from the loops of the net.

Yet, still another object of the present invention is to provide an ornamental net with a netted light assembly that has loops on the one wire twisted adjacent the lamp sockets, the loops allow ornaments to be hung thereform.

These together with other objects of the invention, along with the various features of novelty which characterize the invention, are pointed out with particularity in the claims annexed to and forming a part of this disclosure. For a better understanding of the invention, it operating advantages and the specific objects attained by its uses, reference should be had to the accompanying drawings and descriptive matter in which there is illustrated the preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a plan view of the present invention.

FIG. 4 is an enlarged view of the ornament hanging from a loop of the net of the present invention.

Similar reference characters refer to similar parts through the several views of the drawings.

DETAILED DESCRIPTION OF THE INVENTION

Figure 1:
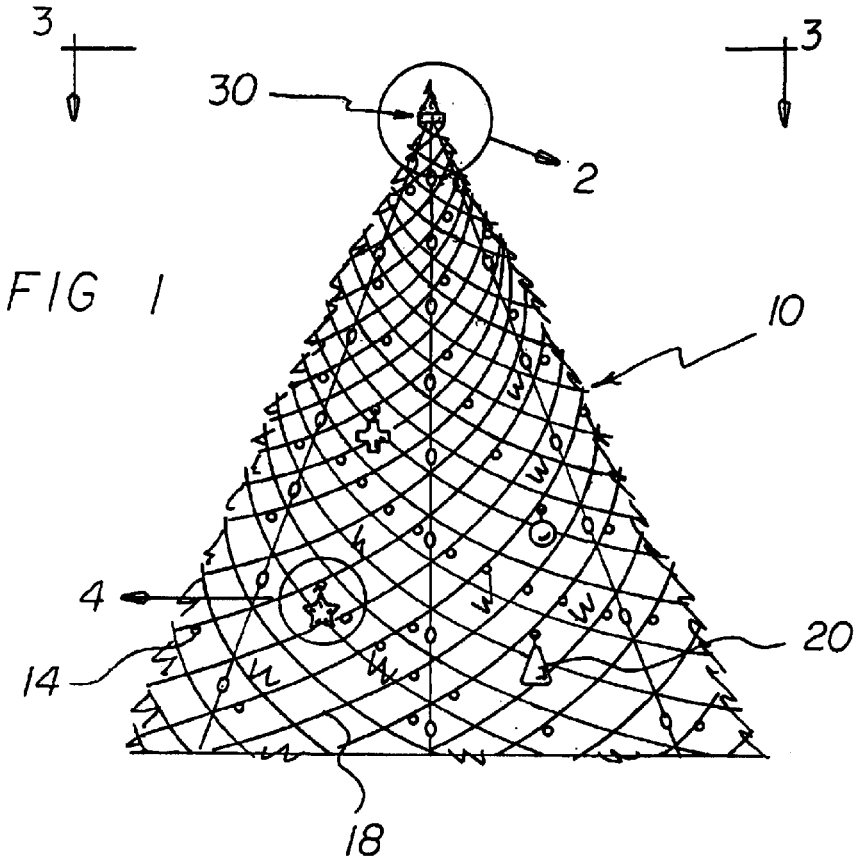
FIG. 1 is a perspective illustration of the preferred embodiment of the ornament netting in an operable orientation and as constructed in accordance with the principles of the present invention.

With reference now to the drawings, and in particular to FIG. 1 thereof, an ornament netting embodying the principles and concepts of the present invention and generally designated by the reference numeral 10 will be described.

The present invention, ornament netting, is comprised of a plurality of components. Such components in their broadest context include web-like structure 12 and integral loops 14. Such components are individually configured and correlated with respect to each other so as to attain the desired objective.

More specifically, the present invention includes an article specifically structured to be mounted onto a tree or other structures. As best illustrated in FIG. 1, the design of the article allows ornaments to be hung therefrom. The main component of the article is a web-like structure 12 created by entwined material 16 that, forms a plurality of mesh 18 with substantially identical dimensions. Each mesh has four substantially equal sides. The mesh size of the ornament netting varies according to its intended use.

The material used to make the ornamental netting may be cotton, synthetic fiber, plastic or flexible metal wire. In the preferred embodiment the material is either a synthetic fiber or plastic. The synthetic fibers are chosen form the class of synthetic fibers know as polyamide, polyethylene, polypropylene, polyester, Lycra®, Nomex®, Kevlar®, Dacron®, Endura® Gold, or Decot. The fiber may be an optical fiber. The use any one of these materials allows the manufacturer of the ornamental netting forming the mesh of the netting with or without knots. Further, the use of any one of the listed materials allows the mesh size to be varied in accordance with the size of the structure or tree in which the ornamental netting is to placed.

During the making of the ornamental netting, an array of loops 14 are formed along the length of the extruded fiber prior to the fiber being entwined to form the mesh of the ornamental netting. The array of loops are integral at least two parallel sides of the mesh of the web-like structure seen in FIG. 3, each of the array of loops allows for ornaments 20 to be suspended therefrom. Specifically, when the ornamental netting is formed by the standard net weaving process, one set of threads used has the loops formed thereon while the other set of threads is loop free. However, to make the manufacturing process easier, all threads used to make the netting can have loops.

Figure 5:
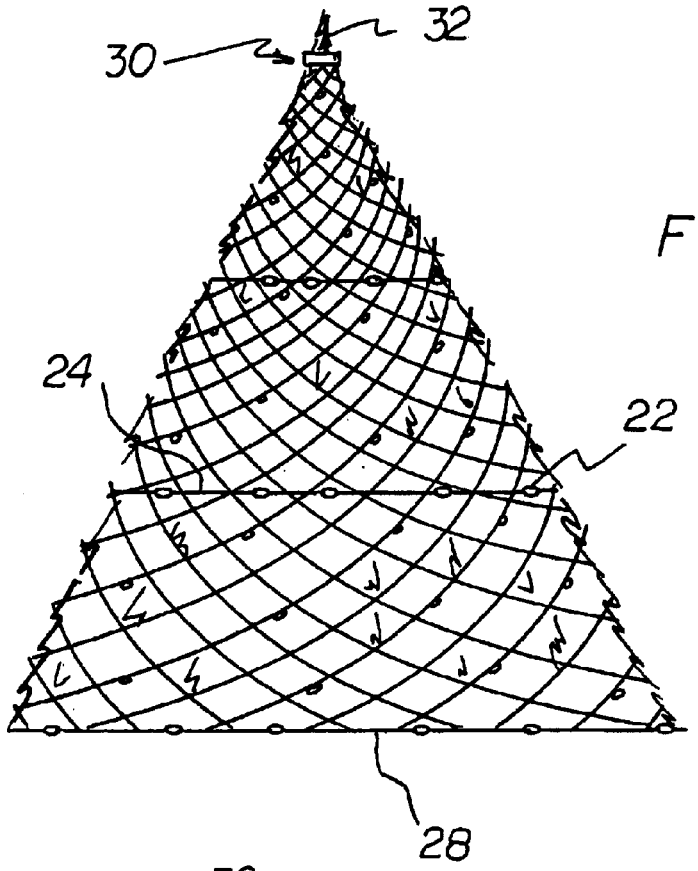
FIG. 5 is side view of the ornament netting in an operable orientation having a vertical weight system.
Figure 6:
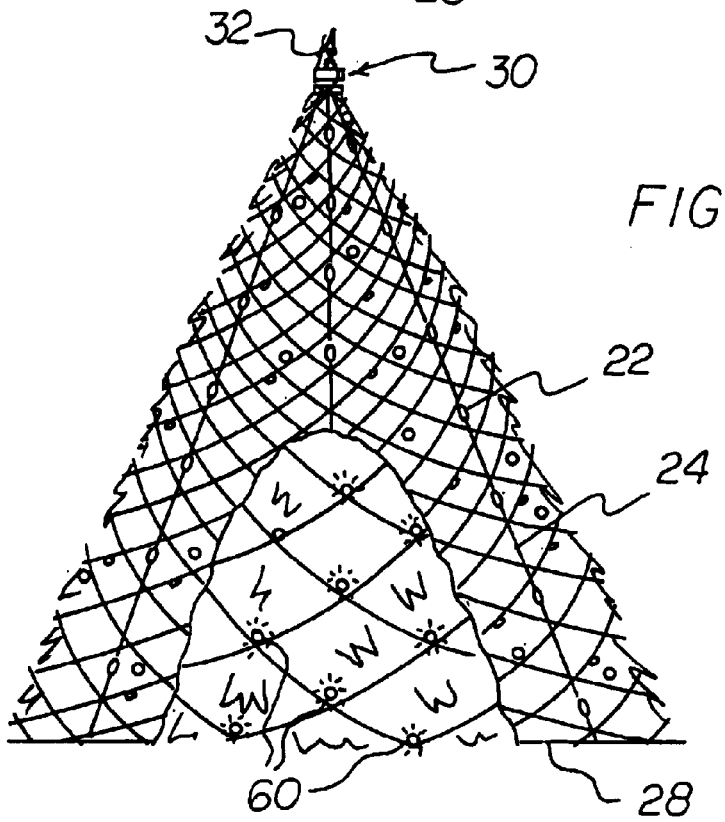
FIG. 6 is a perspective illustration of the ornament netting in conjunction with a light assembly.
Figure 8:
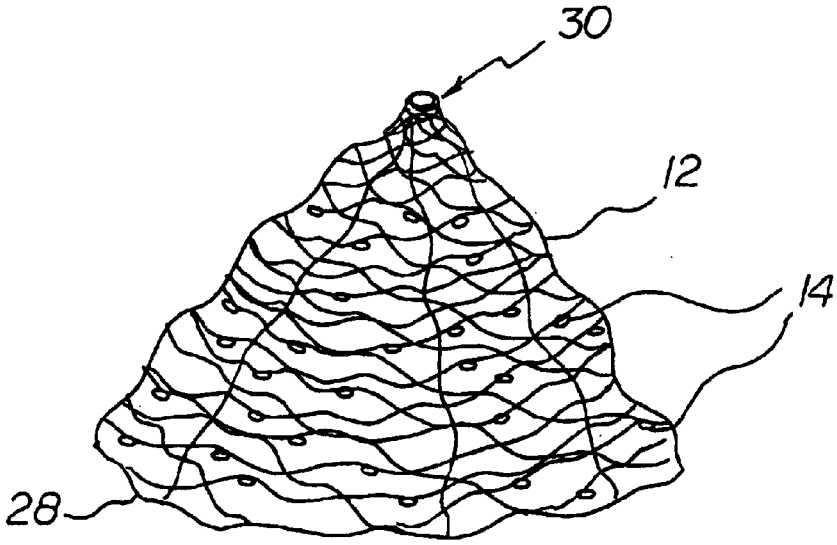
FIG. 8 is a plan view of the present invention showing a network of loops on the net.

After a sheet of ornamental netting is made, it can be cut and re-sewn to from the shapes needed for placement on a structure. Shapes such as conical, circular, square, rectangular or other geometric shapes, being only limited by the imagination of the user. In order for the ornamental netting to function as designed it is important that it be drapable, as depicted in FIG. 8, when placed over a Christmas tree or other structure. The ability to be drapable is most important to the appearance and helping the ornamental netting, when in position to be pleasing to the eye. Therefore, when two or more sheets are to be attached, additional ornamental weighted structures 22 are coupled at the point of attachment. As shown in FIGS. 5 and 6, an elongated length of fiber 24, identical the fiber used to make the ornamental netting, is interconnected at the point of attachment for the plurality of the web-like structures or cut sheet. The elongated length of fiber has a plurality of ornamental weighted structures positioned thereon and proportionately spaced thereon. The ornamental weighted structures ensure that the ornamental netting hangs properly on the Christmas tree or other structure.

The elongated length of fiber runs vertical or horizontal the structure or the Christmas tree, as shown in FIG. 1 and 5 respectively.

Once, the ornamental netting is positioned on the Christmas tree or other structure, hooks with the ornaments attached are coupled with at least one of the loops 14 of the mesh or web-like structure 12 of the ornamental netting. The user chooses which loop to use, following no set pattern of placement. After decorating the tree, the loops also help to maintain placement of the ornaments. For example as the limbs of the tree begin to dry out and become brittle, the hook holding the ornament will not slip from the loop as it would from a brittle branch.

When the user is ready to remove the ornamental netting from the Christmas tree or other structure, the ornaments remain coupled to the ornamental netting. The user and one or more other persons, grabs onto the bottom 28 of the ornamental netting and lifts the netting from the position where it had been hanging. The user can then remove the ornaments from the netting at that time or later. It should be understood, that the user can reverse this procedure for decoration of the Christmas tree or other structure. The user prior to placement of the ornamental netting on the tree, lays the ornamental netting out flat then couple the ornaments on the ornamental netting. After the ornaments are coupled to the ornamental netting, the user and one or more other persons lifts the ornamental netting with ornaments up and over the Christmas tree or structure and lowers it down into position where it is to hang.

To properly position the ornamental netting over a Christmas tree or structure having a similar shape, a plurality of ornamental sheets or web-like structures are attached together and are coupled to a mounting ring 30. The mounting ring is used to position the ornamental netting about the crown 32 of a tree. The mounting ring has an interior circumference of sufficient size to accommodate the crown of the tree.

Figure 2:
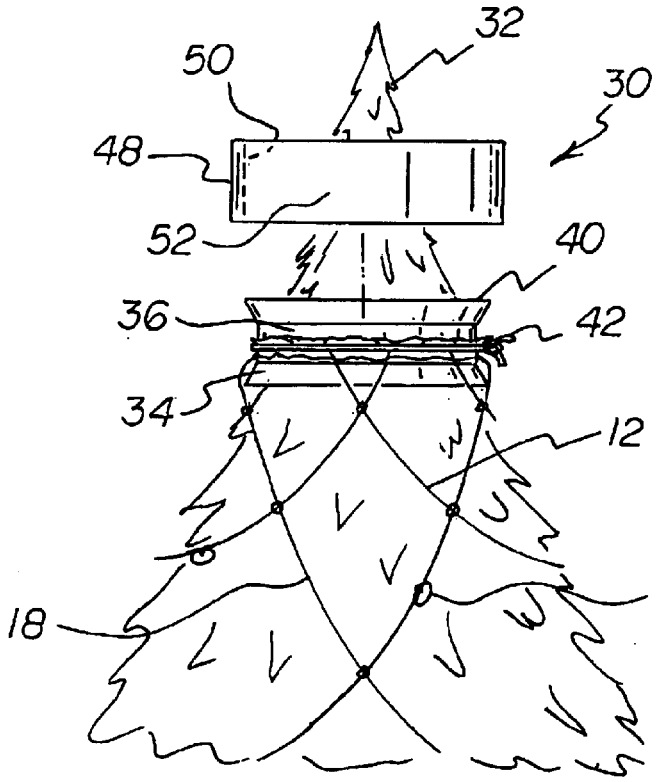
FIG. 2 is an enlarged view of the ring assembly of the ornament netting.

Specifically, as illustrated in FIG. 2, the mounting ring is formed of two rings that are coupled together. The first ring has the web-like structure mounted thereon. The first ring 34 is a spool shaped device with a center portion 36 with a pair of parallel raised outer walls 40 projecting therefrom. The center portion of the first ring having the interior circumferences for receiving the crown of the tree. The center portion of the first ring has a portion of the web-like structure 12 positioned thereabout and further secured there on with a string-tie 42 and an adhesive.

Further, included is a second ring 48 with a top annular 50 wall and a side wall 52 for overlaying the first ring, in a spaced relation thereto. The second ring has a top annular wall and a, side wall that when in position over the first ring functions as an outer wall externally covering the center portion with the web-like structure therearound and both of the outer walls of the first ring. When the second ring is coupled in position over the fist ring, portions of the web-like structure extend from the bottom of the mounting ring. This allows the web-like structure of the ornamental netting with the array of loops to descend from the mounting ring to rest about the tree in a draped manner.

Figure 7:
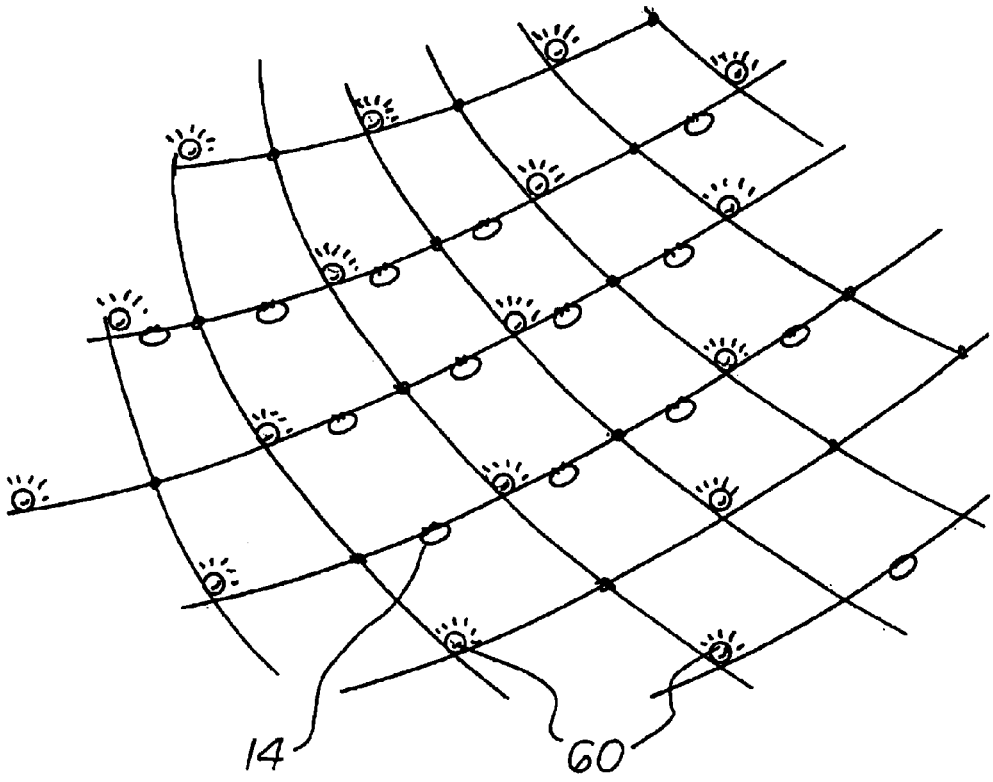
FIG. 7 is a fragmented portion of a net with lighting and ornament loops.

FIG. 7 shows, an alternative embodiment of the invention is a decorative light and ornament assembly for removably and adjustably arranging an array of electrical lights and ornaments about a tree. This embodiment has a web-like structure 12 created by a flexible material capable of forming a plurality of mesh with identical dimensions, each mesh has four sides which are approximately-equal in length and diameter.

The flexible material of the web like structure is a light string that includes a plurality of lamp sockets 60 and a plurality of electrical wires. The electrical wires are formed from a flexible wire with a plastic coating. The plurality of electrical wires define intermediate portions and intermediate adjacent pairs of the lamp sockets. The plurality of wires in each light string is twisted together intermediate the lamp sockets of the light string.

The one wire of each light string is in electrical communication with each of the plurality of lamp sockets of the light string adjacent to each of the lamp sockets without electrically contacting any lamp sockets of any other light string. Included is an array of loops 14 being integral the one wire of the light string that is twisted together adjacent to the lamp sockets of the light string. Each of the array of loops is for suspending ornaments thereon. Specifically, the hooks used to hang ornaments are coupled with the loops of the wire.

With respect to the above description then, it is to be realized that the optimum dimensional relationships for the parts of the invention, to include variations in size, material, shape, form, function and manner of operation, assembly and sue, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. It is not intended to be exhaustive or to limit the invention to the precise forms disclosed. Obvious modifications or variations are possible in light of the above teachings. The embodiments discussed were chose and described to provide the best illustration of the principles of the invention and its practical application to thereby enable one of ordinary skill in the art to utilize the invention in various embodiments and with various modifications as are suited to the particular use contemplated. All such modifications and variations are within the scope fo the invention as determined by the appended claims when interpreted in accordance with the breadth to which they are fairly, legally, equitably entitled.

I claim:

1. An article for mounting onto a tree or other structures and capable of having ornaments hung therefrom, comprising;

a web-like structure created by entwined material forming a plurality of mesh with substantially identical dimensions, each mesh has four equal sides with corners;

an array of loops being integral at least two parallel sides of the mesh of the web-like structure, each of the array of loops for suspending ornaments thereon, each loop being at a central region of a side between the corners; and wherein the ornaments having hooks that are coupled with the loop of the web-like structure.

2. The article of claim 1, wherein a plurality of the web-like structures are interconnected to an elongated length of fiber; said elongated length of fiber has a plurality of ornamental weighted structures positioned thereon and proportionately spaced thereon.

3. The article of claim 2, wherein, the plurality of connected web-like structures being coupled to a mounting ring for positioning about the crown of a tree, the mounting ring has an interior circumference of sufficient size to accommodate the crown of the tree.

4. The article of claim 3 in the mounting ring is formed of two rings that are connected;

a first ring has the web-like structure mounted thereon, the first ring having a center portion with a portion of the web-like structure position thereabout;

a second ring with a top annular wall and a side wall overlaying the first ring, and in a spaced relation thereto and securing the web-like structure onto the first ring; and wherein the web-like structure with the array of loops descends from the mounting ring to rest about the tree.

5. The article of claim 2, wherein the entwined material is selected form the group of fiber making material consisting of cotton, synthetic fiber, plastic or flexible metal wire.

6. The article of claim 2, wherein the entwined material is cotton.

7. The article of claim 2, wherein the entwined material is a synthetic fiber.

8. The article of claim 2, wherein the entwined material is a flexible wire.

9. The article of claim 2, wherein the entwined material is an optical fiber.

10. The article of claim 2, wherein the entwined material is synthetic fiber.

11. An article for mounting onto a tree or other structures a decorative light and ornament assembly for removably and adjustably arranging an array of electrical lights and ornaments about a tree wherein the article comprises:

a web-like structure created by a flexible material capable of forming a plurality of mesh with identical dimensions, each mesh has four equal sides;

the flexible material of the web like structure is a light string that includes a plurality of lamp sockets and a plurality of electrical wires that define intermediate portions and intermediate adjacent pairs of the lamp sockets, the plurality of wires in each light string is twisted together intermediate the lamp sockets of the light string;

the one wire of each light string is in electrical communication with each of the plurality of lamp sockets of the sight string adjacent to each of the lamp sockets without electrically contacting any lamp sockets of any other light string;

an array of loops being integral the one wire of the light string that is twisted together adjacent to the lamp sockets of the light string, each of the array of loops for suspending ornaments thereon; and wherein the ornaments having hooks that are coupled with the loop of the web-like structure.

12. The article of claim 11, wherein, the flexible material is a flexible wire with a plastic coating.

13. The article of claim 11, wherein, the lamp socket includes light emitting diodes.

* * * * *